United States Patent [19]

Duran Romero et al.

[11] Patent Number: 4,662,108

[45] Date of Patent: May 5, 1987

[54] COPLANAR CLOSURE SLIDING WINDOW

[76] Inventors: Gustavo Duran Romero, Avda. de la Iglesia, 100, Humera (Madrid); José-Antonio Munoz Escribano, Urbanizacion Los Chopos, C/Abeto, 6, Gabia (Granada), both of Spain

[21] Appl. No.: 688,346

[22] Filed: Jan. 2, 1985

[30] Foreign Application Priority Data

Jan. 9, 1984 [ES] Spain ..... 276751

[51] Int. Cl.[4] ..... E05D 15/20

[52] U.S. Cl. ..... 49/130; 49/504

[58] Field of Search ..... 49/130, 128, 129, 127, 49/504

[56] References Cited

U.S. PATENT DOCUMENTS

| | | | |
|---|---|---|---|
| 2,889,590 | 6/1959 | Kunkel | 49/130 |
| 2,959,827 | 11/1960 | Barabas | 49/130 |

FOREIGN PATENT DOCUMENTS

| | | | |
|---|---|---|---|
| 1024401 | 6/1958 | Fed. Rep. of Germany . | |
| 831890 | 6/1938 | France . | |
| 1219364 | 12/1959 | France . | |
| 439664 | 12/1967 | Switzerland | 49/130 |

*Primary Examiner*—Philip C. Kannan

*Attorney, Agent, or Firm*—Ladas & Parry

[57] ABSTRACT

A coplanar closure sliding window having improved performance and sealed type characteristics. A window frame is constructed using a single profile, the vertical sections of the window sashes being formed by another profile and a horizontal section of sashes being constructed from a third type of profile.

5 Claims, 9 Drawing Figures

COPLANAR CLOSURE SLIDING WINDOW

The present invention refers to a coplanar closure sliding window which has been designed to carry out two main objectives, viz.:

1. To drastically reduce the production costs of the window, by decreasing the expenses of the materials used and reducing the hand labour time, obviating the incorporation of superfluous materials and accessories.

2. To remarkably improve the performance and services of a sliding window, potentiating the sealtight characteristics thereof.

Sliding windows having a metal or a wooden structure, the sashes of which lay in the same plane when the window is closed and in parallel planes when the window is open, have been known for many years. In this direction, the following patents can be cited: German Pat. No. 1,024,401 filed on Aug. 21, 1954, U.S. Pat. No. 2,889,590 filed on July 30, 1956, as well as French Pat. No. 831,890 filed on July 29, 1975 and French Pat. No. 1,219,364 filed on Dec. 26, 1958. Finally U.S. Pat. No. 2,959,827 filed on Nov. 7, 1958.

All these patents refer to structures relative to sliding windows having the aforementioned characteristics, that is those which can be called coplanar closure sliding windows.

There are also Spanish registrations referring to this subject. Thus, the following can be cited: Patent of invention 506,024 filed on Oct. 5, 1981, Utility Model 267,318 filed on Sept. 16, 1982 and Utility Model 274,043 filed on Aug. 18, 1983.

Thus, in spite of this high number of registrations defining the state of the art, the present invention provides, as will become clearer throughout this specification, a series of improvements which remarkably better a window incorporating these characteristics, eliminating all the shortcomings inherent to the various embodiments pertaining to the prior art.

To technically support the aforegoing allegations, it can be stated that, in principle, a metal window, such as aluminium sliding windows, must be constructed using six profiles having different structures. One profile is used to construct the side section of the window frame, whilst another type of profile defines the upper section, the frame structure being completed with another type of profile defining the lower section. To construct the window sashes, another three different types of profiles are necessary, since one of them constitutes the vertical section of the central sash, another type constitutes the vertical sections of the sides of the window sash, and a third type constitutes the horizontal sections which close the rectangular structure of each window.

As can be understood, the production, purchase and subsequent storage of six different types of profiles involve a high expenditure which, necessarily, has a bearing on the cost of the constructed window. In spite thereof, a high majority of the aforementioned patents require these six types of profiles to make the structure being defined.

With the idea of overcoming this disadvantage, the structure described in Utility Model 274,043 was registered, which consists of an improved sliding window having a sealed closure.

This window constitutes the most up-to-date embodiment and, in principle, improves all the windows of the mentioned registrations, wherefore the merits of the prevents invention will be discussed subsequently based on the structure thereof.

To industrially exploit the window of Utility Model 274,043, only four different types of profiles are necessary, which clearly imply an improvement in the construction of windows, since two types of profiles were eliminated. The entire frame was constructed with a single profile and the respective sliding sashes of the sliding window were formed with the remaining three types of profiles.

Hence, a window constructed in accordance with the structure of the present invention, is only and exclusively made from the functional association of three different types of profiles, which clearly implies a substantial reduction in the production costs of a window.

The entire window frame is constructed using a single profile, all the vertical sections of the window sashes being formed of another profile having an exceptional design, whereas the horizontal sections of the sashes are constructed from a third type of profile.

Apart from this important reduction in the number of profiles to be used, which clearly constitutes a highly important characteristic for constructors, the window of this invention has other important characteristics of design which will be described.

Following the comparative criterion relative to the prior Utility Model 274,043, it must be pointed out that the closure of a window made in accordance with this utility model was produced when one of the sliding sashes of the window was fastened to inclined planes or wedges which forced this sash to be positioned coplanar with the other respective sash, each sash sliding up to this moment, along concave rails in the profile constituting the frame which had a general U-shaped structure. To change the rail in the central part of the window and in the horizontal sections of the frame thereof, deflecting devices were provided, whilst the sashes eliminated the clearances when sliding along such sections with the presence of pistons provided with corresponding springs.

The closure between sashes was effected through the intrinsic structure of the profile which defined the vertical sections thereof, which profiles incorporated rubber seals which were perfectly visible from the outside.

The assembly was closed by placing in the window a three-point closure which actuated the corresponding sash fasteners.

Although this entire structure, from a theoretical point of view, permits a correct functioning, it presents, when put into practice, a series of technical problems requiring special attention at the time of construction.

Firstly, the incorporation of a relatively high number of accessories, such as the pistons, the wedges, the deflectors, the sash fasteners, etc., forces the constructor to have a warehouse sufficiently large to store them. Besides, the time required by specialized personnel to include these accessories is considerable, wherefore the finished product is logically more expensive.

On the contrary, the window of the present invention discards a high number of all these accessories, presenting a dual interest since apart from not having to purchase them, they do not have to be incorporated when constructing the window.

Referring to the main characteristics of this invention, it must be pointed out that the profile determining the shape of the window frame is made with an intrinsic and studied design which not only permits the entire configuration of the frame with a single profile, but its different sections carry out interesting services, referring to both the vertical sections of the frame and the horizontal sections thereof.

Besides, it must be pointed out that since the window frame has a U-shaped configuration and its central section has a straight section, the sliding sashes could slide along this central section easily, whilst facilitating machining of the frame itself. Differing therefrom, the profile of Utility Model 274,043 presented at its central zone two concave grooves along which the window rolled. However, it has been verified that as time passed, a large amount of dust and dirt accumulates in such grooves, which apart from preventing the correct sliding of the sliding sashes, acted as an emery deteriorating the surface of the horizontal sections of the frame.

The profile constituting the frame has two longitudinal wings disposed at its central section, which will act as guides for the sliding sashes, referring to the horizontal sections of the frame. However, in the vertical sections, one of these guides plays the important role of a deflecting device of the window sashes, leading them to their closed position. Simultaneously, due to the configuration of this profile determining the frame, it is not necessary to house a gutter rail in the lower horizontal section thereof, since this will be integrated in the structure itself of the window frame, precisely due to this structure with which it has been provided.

Referring to the profile determining the vertical sections of each of the sashes, it must be pointed out that it also presents a very exceptional configuration.

It differs in a plurality of aspects from the profiles normally used to carry out this function and, more particularly, from the profile of Utility Model 274,043 which carried out this function, in that it does not incorporate the bevelled face by means of which the two window sashes were coupled.

Thus, it incorporates a dovetailed recess which, at one of the faces of the window sash, will project into a wing beneath which will be housed a seal, the predominant part of which will fit into the mentioned dovetailed recess so that a perfect sealed closure is obtained between the two window sashes, while the seal is completely hidden from the user, remarkably improving the outlook of the closure obtained, a fact which was not obtained with the structure adopted in the mentioned Utility Model 274,043.

Finally, referring to the profile determining the horizontal sections of the window sashes, it must be pointed out that it incorporates a widening which will operatively be used to absorb the difference in thickness originating when one of these profiles is coupled to the corresponding vertical profile of the window sash, in order to improve the tightness of the assembly when the corresponding tightening profile is placed against the window frame.

To complement the description which will now be made and for a better understanding of the characteristics of the invention, this specification is accompanied by a set of drawings forming an integral part thereof, wherein illustratively and not limiting the following is represented:

Figure 8:
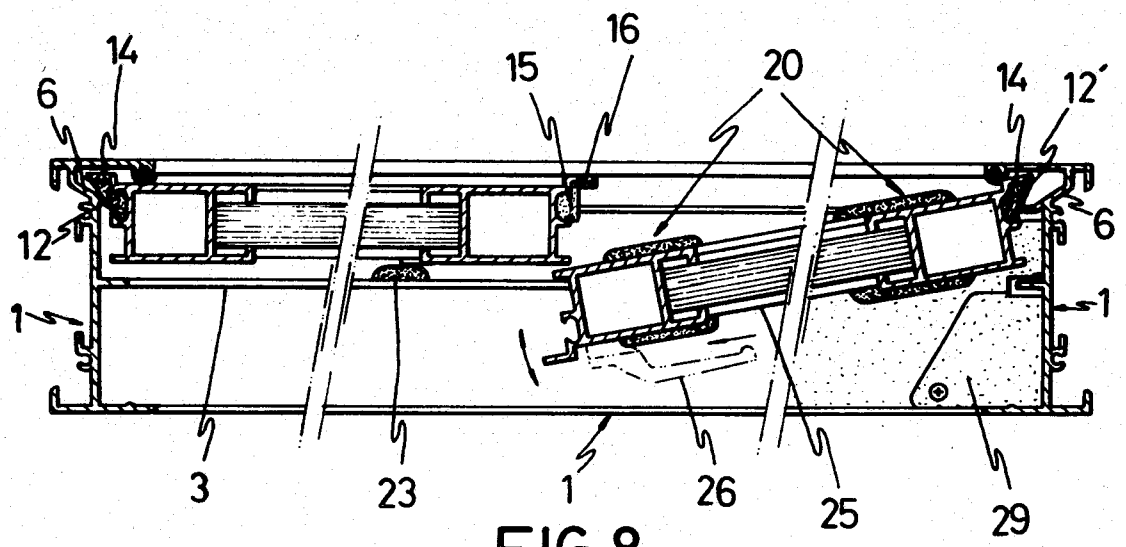

FIG. 8 corresponds to a sectional view, similar to the preceding, in which the slidable sash is carrying out the change in plane, that is, the opening of the sliding window is being initiated.

Figure 9:
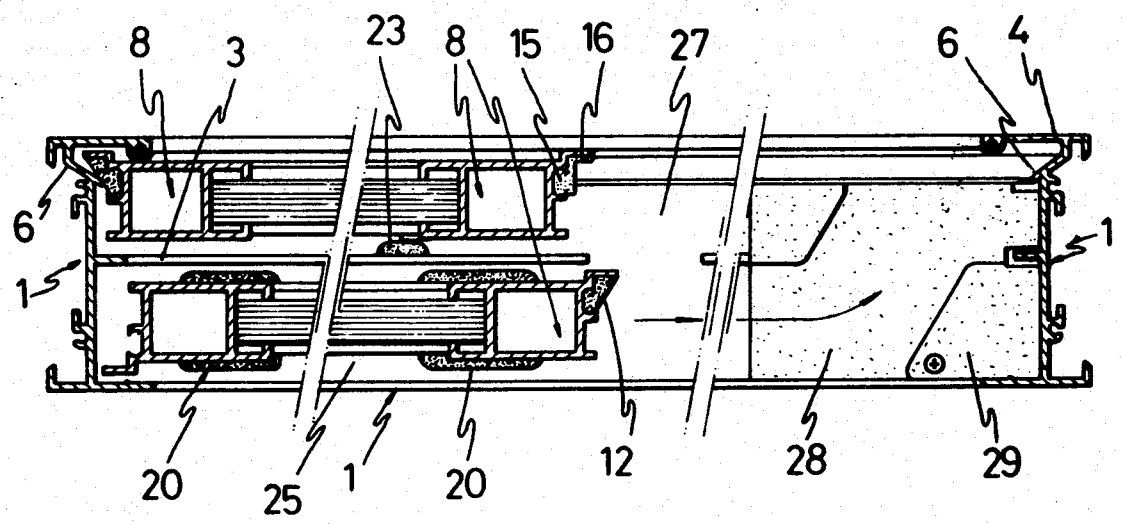

FIG. 9 represents a view corresponding to the two preceding figures in which the window has been opened, the sashes thereof being placed, as illustrated, according to two parallel planes and both sashes being capable of sliding freely along their sliding zones.

Referring to the mentioned figures and as can be seen, the coplanar closure sliding window of the present invention is comprised of only three profiles, differing from one another.

Figure 1:
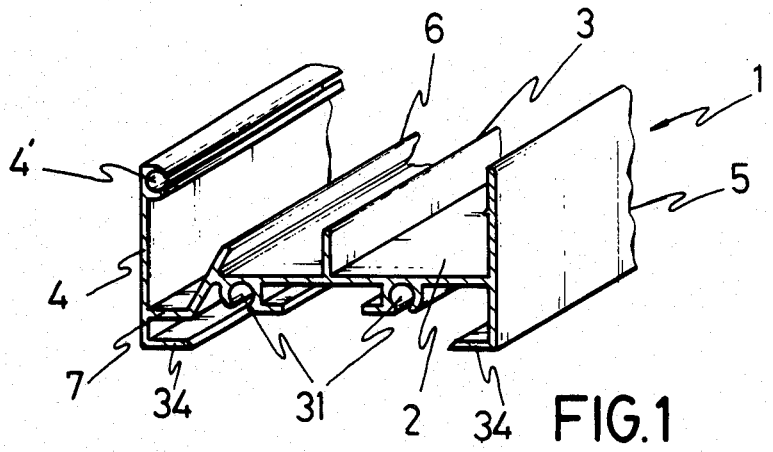
FIG. 1 represents a perspective view of a section of the profile constituting the entire window frame.

The profile 1 represented in FIG. 1 constitutes the entire window frame. As can be seen, this profile has a predominantly U-shaped configuration, its central section 2 being completely flat, and at a centered zone thereof there is a longitudinal flange 3 normal to its plane.

Besides, this central section 2 does not join the two wings 4 and 5 of the profile, but ends in an inclined wing 6 which projects in an inclined position from a point lower than this central section 2, ending at a short horizontal sector 7 to be joined to the wing 4.

It must be pointed out that this inclined wing 6 will play an important role in the correct functioning offered by this sliding window, furthermore forcing the sashes to exert a pressure on a perimetral weatherstrip placed in the rail 4' of the wing 4.

Figure 2:
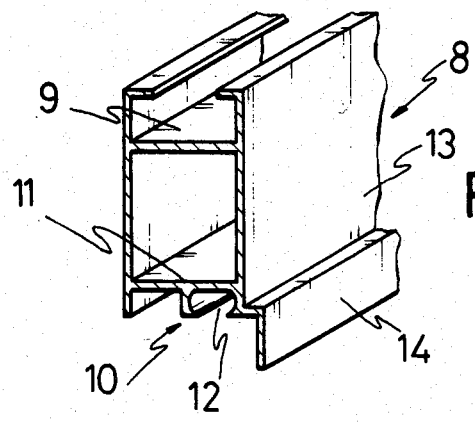
FIG. 2 represents a perspective view of a portion of the profile constituting the vertical sections of the sashes of this coplanar closure sliding window.

FIG. 2 illustrates the configuration of the profile 8 determining the vertical sections of the window sashes.

This profile 8 has a zone 9 which will be coupled to a profile determining the horizontal sections of the window sashes. However, the most characteristic part of this profile 8 resides in its face or front 10 which has a flat zone 11 and a dovetailed rail 12 which, at the outer face 13 of this profile 8 projects into a stepped projection 14. This configuration is highly important at the time of coupling or closing the window between the two sashes, as well as at the time of producing displacement thereof to the operative closure position, as will subsequently be described.

This dovetailed recess 12 will be provided with a tight seal 15 pressure-coupled in the recess and having a lip 16 which will be housed beneath the projection 14.

Figure 3:
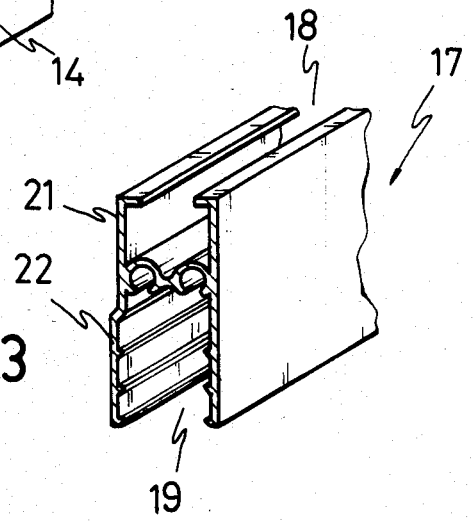
FIG. 3 represents a perspective view of a section of the profile constituting the horizontal sections of the window sashes, that is, the profile that, associated with that illustrated in the preceding figure, forms the structure of the sash.
Figure 4:
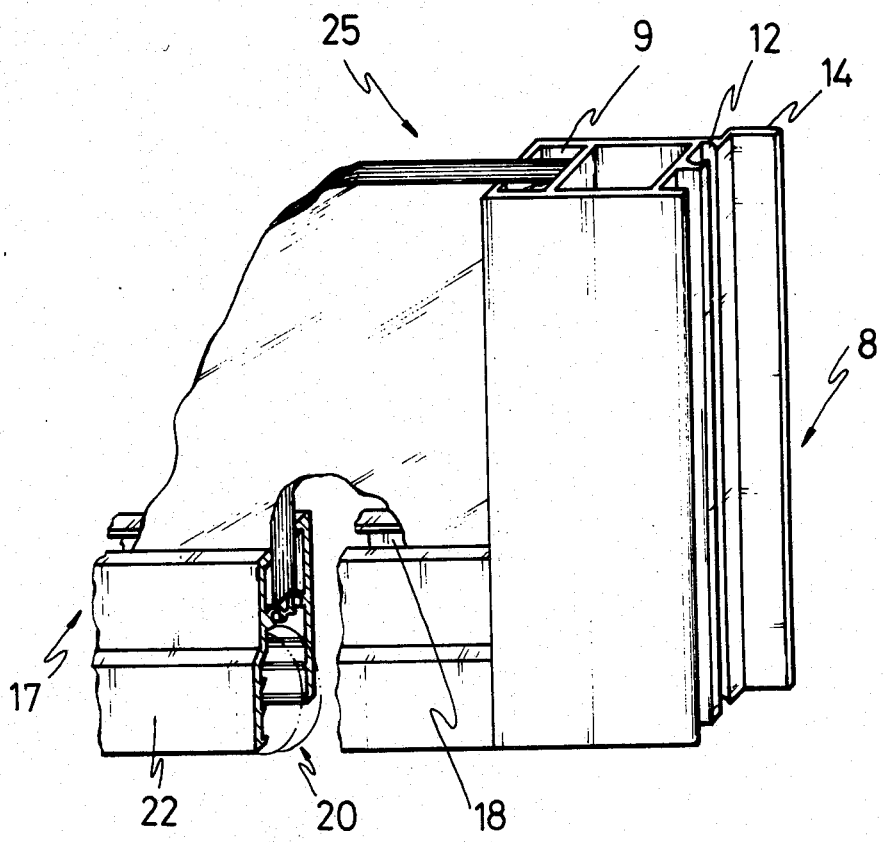
FIG. 4 represents a portion of a sash of this sliding window, it specifically, due to the position illustrated in this figure, represents the sash which effects the sliding or the change in plane.

The horizontal sections of the window sashes are constructed with the profile 17 illustrated in FIG. 3. This profile has an upper zone 18 in which will be housed the edges of the window pane and a lower zone 19 in which will be housed the roller supports 20 of the window itself, as well as complementary cleaning or sweeping elements of the rolling, adjustment and sealing zones of the wings thereof.

The face 21 which will be located at the outer zone of the window, incorporates a widening 22 whereby the difference in width between profiles will be compensated when this profile 17 is coupled to the profile 18, to form a window sash.

Figure 6:
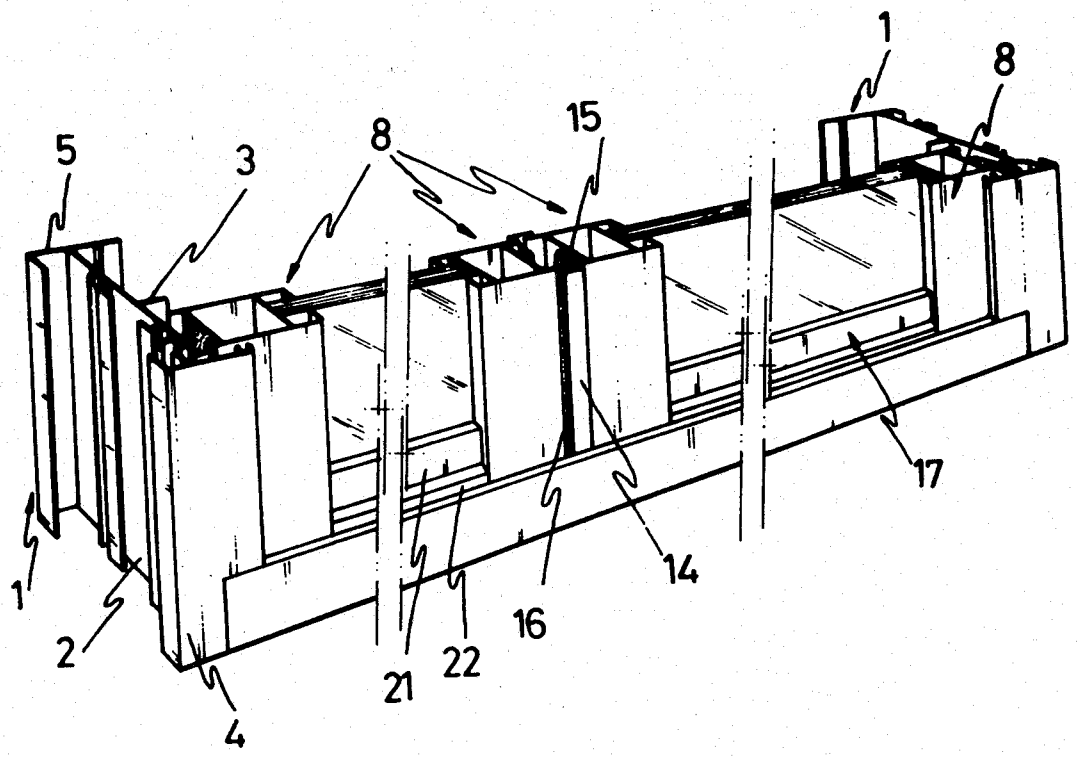
FIG. 6 represents a perspective view of a section made in a window constructed in accordance with the characteristics of this invention, the sashes of which window are in a position corresponding to a closed window.

According to this entire structure, a window is obtained whose exterior appearance can be seen in FIG. 6 in which not only the perfect sealed closure effected by this window is illustrated, but also the appearance proportioned by it, since the appearance offered by the two central vertical sections of the window is completely symmetrical, that is the amplitude of each of these sections 8 is practically the same, differing from other embodiments in which the system or configuration adopted prevented this appearance from being obtained.

Figure 7:
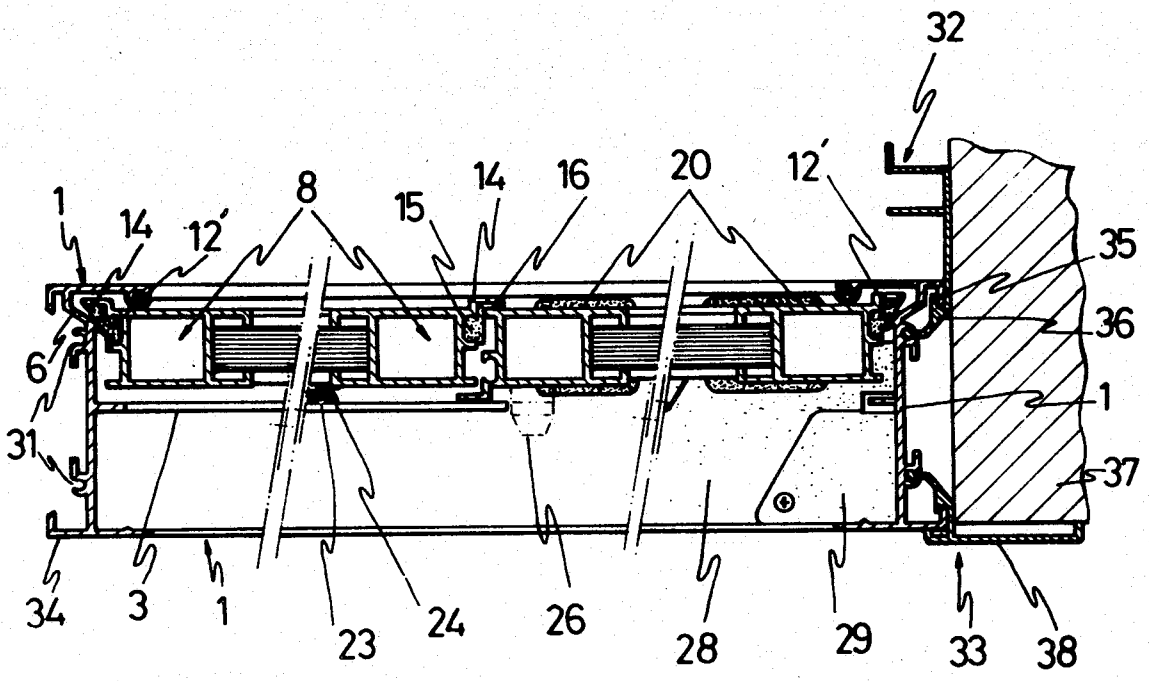
FIG. 7 represents a schematic diagram of a section made according to a horizontal plane of a window constructed in accordance with the invention, illustrating the various characteristics thereof.

As will be seen, in the closed position of the window, FIG. 7, the inclined wings 6 of the frame 1 press a rubber piece 12' fixed to the cut outs 12 and supported on the stepping 14 of the corresponding profile 8, which causes a displacement of the sash to be placed under pressure against the perimetral weatherstrip of the wing 4 of the frame, thereby obtaining a sealed closure. In this way, the inclined wings 6 act as a bolt or locking element.

Closure is complemented by the pressure exerted by the set of wedge and counter-wedge 23 and 24 secured to a zone of the frame and at the lower part of the fixed sash respectively, this being blocked.

Referring to the central zone of the two window sashes, this FIG. 7 illustrates how the closure obtained is entirely sealed and, besides, utilizing the elastic characteristics of the rubber seals 15, the closure is completely silent, thereby obtaining a determined pressure characteristic in the closure obtained, upon actuating the closure and opening control 26.

From this closure position illustrated in FIG. 7, the opening operation will now be described, which is initiated with the position shown in FIG. 8.

To obtain this, the corresponding zones of the flanges 3 of the frame 1 have breaks 27 permitting the passage of the roller elements 20 of the sashes, so that by means of a mere pulling operation, the window sash 25 is no longer in the closed position of FIG. 7, initiating the change of plane operation. It must be pointed out that this operation, since it takes place on a perfectly flat surface, does not involve any additional strength on the part of the user, this opening operation terminating in the position illustrated in FIG. 9, which illustrates how the two sashes are in two parallel planes occupying the entire window frame and the sashes are, therefore, in a position to be able to move along the entire width of the frame or to return to the closed window position. The sides of the roller supports 20 slide guided in the rails formed at one side and the other of the central flange 3.

To explain how this closure of the window is produced, to return to the position of FIG. 7, it must be stated that by proceeding in an inverse direction to that mentioned, a position similar to that illustrated in FIG. 8 is adopted, when the right roller support 20 reaches the guide passage 28 formed in the piece 29 fixed to the profile 1. The mentioned guide passage 28 is a groove made in the free surface of the piece 29, preferably of plastic.

From this latter arrangement, when the moveable sash 25 is sagged, by pressing on the operating control 26, the inclined seal 12' is constrained by the inclined wing 6 of the frame, wherefore said sash 25 is displaced parallel to itself, being placed against the peripheric weatherstrip of the wing 4 of the frame. Simultaneously, this closing pressure is also communicated to the fixed sash which likewise experiments an overpressure to be hermetically placed against said closure weatherstrip.

When turning the control 26 to close the window, the movable sash 25 is securely fastened to the fixed sash which, according to the prior description, is completely blocked during the turn by the wedging of the wedges 23 and 24.

Thus, this entire structure proportions a completely sealed, coplanar closure sliding window which improves a series of characteristics of already known windows of this type, since apart from eliminating the functional disadvantages represented by them, inasmuch as they proportion a completely correct use and operative functioning, it eliminates the incorporation of a high number of component parts, with the repercussions this detail have on the cost of the finished product, to which must be added the saving in hand labour also involved therein.

The advantage presented by this embodiment must also be emphasized, since a window having the mentioned services can be obtained by using only three component profiles, something which has not been obtained heretofore.

Figure 5:
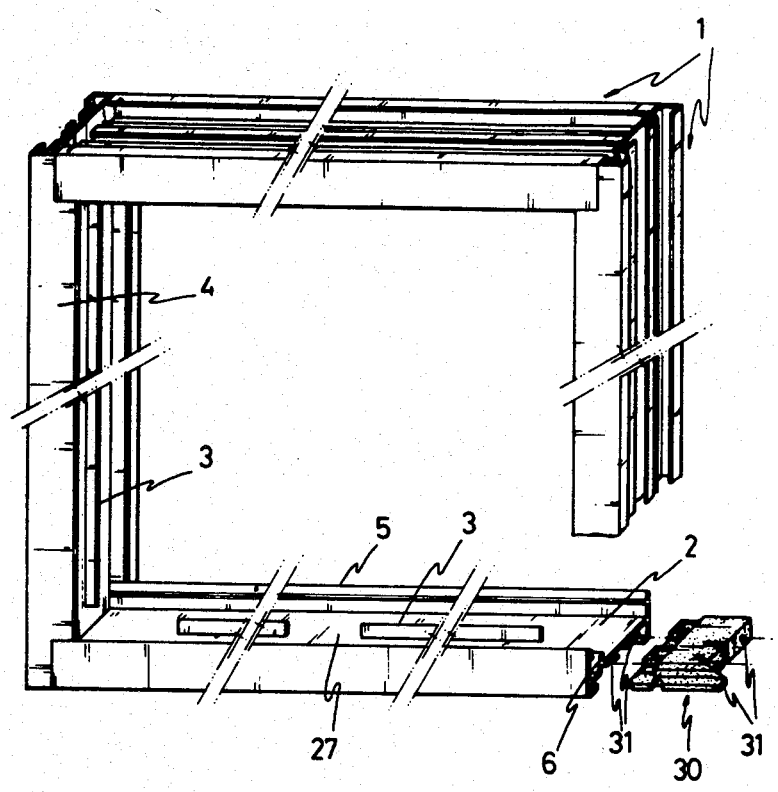
FIG. 5 represents a perspective view of a complete frame of this coplanar closure sliding window.

Referring to FIG. 5, the square joining between the metal profiles of the frame 1 can also take place by means of the pieces 30, whereby a watertight closure is obtained. This prismatic piece 30 is preferably obtained by plastic injection, in which a part of its geometry fits by sliding into the outer part of the profile comprising the window frame, the mentioned piece having another part of its geometry emerging from the frame profile and which is capable of entering tightly in the remaining zone of the profile of the frame determining the other wing of the square. The joining between both profiles is secured by screws passing through the holes 31 provided in the joining element 20 and placed in correspondence with the self-tapping screws 31 of the profile of the frame 1.

There is a series of complementary profiles which can be coupled to the base profile of the window frame 1, such as those referenced 32 and 33 in FIG. 7. The profile 32 illustrates the guide profile for the blind, being coupled, as illustrated in this figure, by sliding on the profile 1 of the frame, when a curvilinear end swelling of this profile 32 is inserted in the corresponding self-tapping screw 31 of the profile 1, simultaneously as the bent end 34 of the profile 1 is inserted between the core of the profile 32 and a projection 35 parallel thereto, emerging from its oblique section 36.

The profile 33 illustrated in this FIG. 7 acts as a joint cap for the joining between the profile 1 and the wall 37, having a general T shape, the centre of which has an oblique bending 36, finished in another swelling which is inserted in the corresponding self-tapping screw 31 of the profile 1, from which oblique section emerges another flange 35 to carry out fastening in the same manner as the profile 32 of the blind. The crossbar 38 of the "T" has a bending at its ends to be placed against said profile 1 and wall 37.

We claim:

1. A coplanar closure sliding window of the type in which the sashes lay in two parallel planes when the window is open and in the same plane when the window is closed, providing a completely sealed closure, characterised in that it comprises the functional association of only three types of profiles; a first profile, said first profile comprising the window frame and having a substantially U-shape configuration, its central section being flat, said central section having a flange perpendicular to its plane, said central section having an inclined wing at its end, said inclined wing projecting in a inclined position from a position below said central section, said inclined wing ending at a horizontal section 7, said horizontal section 7 joined to wing 4 and; a second profile, said second profile comprising the vertical sections of the sashes, said second profile having a zone 9 which is coupled to a third profile, the front portion of said second profile having a substantially flat zone 11 and a dovetail shaped recess 12 which, at the outer face 13 of said second profile, projects into stepped projection 14, said dovetailed recess 12 having a tight seal 15 pressure-coupled in the recess and; a third profile determining the horizontal sections of the window sashes, said third profile having an upper zone 18 which houses the edges of the window pane and a lower zone 19 which houses roller supports 20 of the window and said third profile having a widening 22 on one of its sides, said widening 22 compensating for the difference in width between profiles when said third profile is coupled to the second profile to form a window sash.

2. A coplanar closure sliding window as defined in claim 1, characterized in that sealing means is provided in the sashes, said sealing means comprised of an elastic seal which is housed in the dovetailed recesses of the second profiles of the window and has elastic lips placed on the stepped projections, which seals, when the window is in a closed position, act in coordination with the wedging action conferred thereto by the corresponding stepped projection of the corresponding side vertical section.

3. A coplanar closure sliding window as defined in claim 7, characterized by incorporating locking means when the window is in a closed position, cooperatively determined by one of the longitudinal wings of the vertical profiles of the frame and by clips housed in the dovetailed recesses formed by the side vertical profiles of the window sashes.

4. A coplanar closure sliding window as defined in claim 1, characterized in that there is a gutter rail said gutter rail being integrated by the inclined plane of the lower horizontal section of the frame.

5. A coplanar closure sliding window as defined in claim 1, having complementary wedge and counter-wedge elements characterized in that said complementary wedge and counter-wedge elements can be placed at corresponding points of the horizontal profiles of the frame and of the window sashes.

* * * * *